US008029649B2

(12) United States Patent
Fiedler et al.

(10) Patent No.: US 8,029,649 B2
(45) Date of Patent: Oct. 4, 2011

(54) METHOD AND DEVICE FOR REMOVING LOOSE MATERIAL ON WAVY SURFACES OF STAMPED COAL USED FOR COKING

(75) Inventors: Norbert Fiedler, Friedrichsthal (DE); Wilfried Schwan, Neunkirchen (DE)

(73) Assignee: Flsmidth A/S, Valby (DK)

( * ) Notice: Subject to any disclaimer, the term of this patent is extended or adjusted under 35 U.S.C. 154(b) by 201 days.

(21) Appl. No.: 12/308,823

(22) PCT Filed: Jun. 20, 2007

(86) PCT No.: PCT/EP2007/005398

§ 371 (c)(1),
(2), (4) Date: Feb. 9, 2009

(87) PCT Pub. No.: WO2008/003400

PCT Pub. Date: Jan. 10, 2008

(65) Prior Publication Data

US 2009/0321242 A1 Dec. 31, 2009

(30) Foreign Application Priority Data

Jul. 1, 2006 (DE) ..... 10 2006 030 524

(51) Int. Cl.
*C10B 45/02* (2006.01)

(52) U.S. Cl. ..... 201/6; 201/40; 202/262; 202/266; 202/270

(58) Field of Classification Search ..... 201/5, 6, 201/40; 202/266, 270, 262; 264/120; 425/427, 425/431; 44/596
See application file for complete search history.

(56) References Cited

U.S. PATENT DOCUMENTS 3,784,034 A * 1/1974 Thompson ..... 414/180
6,059,932 A * 5/2000 Sturgulewski ..... 202/262

FOREIGN PATENT DOCUMENTS

WO 91/02781 3/1991

OTHER PUBLICATIONS

Braun N V et al: "Ramming of a Coal Charge and Outlook for Its Use in the USSR", 1987, No. 4, 1987 pp. 1-7, XP002449501.

* cited by examiner

*Primary Examiner* — Jill Warden
*Assistant Examiner* — Joye L Woodard
(74) *Attorney, Agent, or Firm* — Lucas & Mercanti, LLP; Klaus P. Stoffel

(57) ABSTRACT

According to the invention, the loose coal is displaced from the peaks to the valleys of the waves on the narrow, long coal cake and is beaten down on the coal cake. The inventive device comprises at least one scraper (12) and at least one vertically movable impact plate (13) that are disposed one behind another and are fitted with a connection (7) to a holder. Furthermore, means are provided for generating a relative movement between the scraper (12) and the impact plate (13) and between the scraper (12) and a stamping form. The scraper (12) and the impact plate (13) are interconnected by means of a device frame (14) so as to form a structural unit (6) that is connected to the holder. Preferably, the structural unit (6) can be moved along the stamping form and is equipped with a drive unit. For this purpose, the holder encompasses a guide that extends along the stamping form as well as a carriage or a car which can be slid or moved on said guide and to which the unit (6) is connected with the aid of a boom.

13 Claims, 5 Drawing Sheets

METHOD AND DEVICE FOR REMOVING LOOSE MATERIAL ON WAVY SURFACES OF STAMPED COAL USED FOR COKING

BACKGROUND OF THE INVENTION

The invention relates to a method for removing loose coal on wavy surfaces of long, narrow coal cakes that have been compacted by stamping and are used for coking by scraping off the loose coal.

In addition, the invention relates to a device for accomplishing the method.

To compact coal with a high content of volatile constituents, granular coal is filled into molds and compacted there by means of stamping. Stampers are used which have to be disposed spaced apart due to structural constraints and accordingly are not able to work the entire cross-section of the coal cake. Consequently, at the end the surface is not uniformly compacted; wavy regions are formed with loose lying coal on peaks and tamped coal in valleys.

Since the loose coal is swirled around the coke oven by the gas flows during the coking process, causing heavy contamination there, it has to be removed from the coal cake beforehand.

In the case of the aforementioned method known through usage, when the coal cake is displaced into the coke oven, the loose coal is pushed off the coal cake out to the sides by means of a plow-like scraper, which is intended to set up a defined spacing between coal cake and oven ceiling, and falls into chutes installed next to the coal cake. A conveyor transports said coal away to be re-processed. The rest of the loose coal remains on the surface of the coal cake.

SUMMARY OF THE INVENTION

It is the object of the invention to reduce further the contamination of coke ovens.

This object is achieved as claimed in the invention in that the loose coal is displaced from the peaks to the valleys and is beaten down on the coal cake.

The device as claimed in the invention for accomplishing the method is characterized in that at least one scraper and at least one vertically displaceable impact plate are disposed one behind another and include a connection to a holder; in addition means are provided for a relative movement between scraper and impact plate on the one hand and a stamping mold on the other hand.

The coal cake and the scraper with the impact plate are moved relative to one another either when the coal cake is displaced into the oven or by moving the scraper and impact plate on the coal cake.

The scraper is positioned at the level of the surface of the coal cake such that during the relative movement it displaces the loose coal from the peaks into the valleys. An extensively planar surface is then formed. Said surface is then beaten down by the impact plate, which is disposed behind the scraper and, as a rule, is moved by means of unbalance motors. The coal, which is now firmly bonded to the coal cake, can no longer be swirled around during the coking process and can no longer contaminate the oven.

Since the loose coal is not pushed to the side of the coal cake and thus removed from the coal cake, it is not necessary to have containers receiving the scraped off coal. Rather, the entire mass that is put into the coal cake mold can now be coked directly. Re-processing and the transport etc. connected therewith can now be omitted completely.

The scraper and/or the impact plate are preferably vertically adjustable. Consequently, they can be adapted to the level of the coal cake to be worked.

In a particularly expedient development of the invention, the scraper and the impact plate are interconnected by means of a device frame to form a structural unit, which frame is connected to the holder.

The scraper and the impact plate are thus retained and guided together.

It is expedient for the impact plate to be connected to the device frame by means of a vertical telescopic guide with damping elements. The impact plate can consequently be automatically adapted to the level of the cake.

The damping elements reduce transmission of the impacts caused by the impact plate on the rest of the structural unit and its holder and the mechanical load on the connection or respectively the holder.

In another development, the scraper and the impact plate or respectively the structural unit are connected to the holder, preferably by means of a rod assembly, so as to be vertically adjustable.

It is expedient for the holder to be disposed on a mobile charging unit next to the stamping mold, the stamping mold and means for filling and displacing it being associated with the said charging unit, and the connection includes a boom that extends from the holder, to which boom the scraper and the impact plate are connected, and the holder includes a torque bracket for the torque generated by the boom.

The holder developed in this manner is secured on only one side of the coal cake. The fixed support of the stamping mold on one side is available for this purpose, whereas on the other side it is possible to displace the support, together with the mold wall there, to the side once the coal cake has been produced so that the coal cake can be released from the mold.

In a further development of the invention, the structural unit can be moved along the stamping mold and is provided with a driving means.

The speed at which the structural unit works the surface of the coal cake can consequently be controlled as desired. This is especially significant for the beating down of the coal by means of the impact plate.

It is expedient for the holder to include a guide that extends along the stamping mold and a cradle that is displaceable on the said guide or a carriage that can be moved thereon.

These can also be secured completely to the fixed support of the stamping cake mold.

In another development, the carriage, which is preferably provided with a support frame that holds the boom, is mounted by means of rollers on rails, which are disposed on girders, preferably T girders, which are preferably interconnected and secured to a base, and at least one roller disposed under a side of a T beam forms the torque bracket.

In another specific development, the scraper and the impact plate or respectively the structural unit are disposed on the charging unit at the end of the stamping mold facing a coke oven, wherein the means for the relative movements are those for the displacement of the coal cake into the coke oven.

The surface of the coal cake is worked by the structural unit whilst the coal cake is displaced into the coke oven. In this case, the processing must however be matched to the speed of insertion of the coal cake into the chamber of the coke oven.

BRIEF DESCRIPTION OF THE DRAWING:

The invention is now to be described in more detail by way of an exemplary embodiment and by way of the enclosed drawings that relate to the said exemplary embodiment. In the drawings.

DETAILED DESCRIPTION OF THE INVENTION

Figure 1:
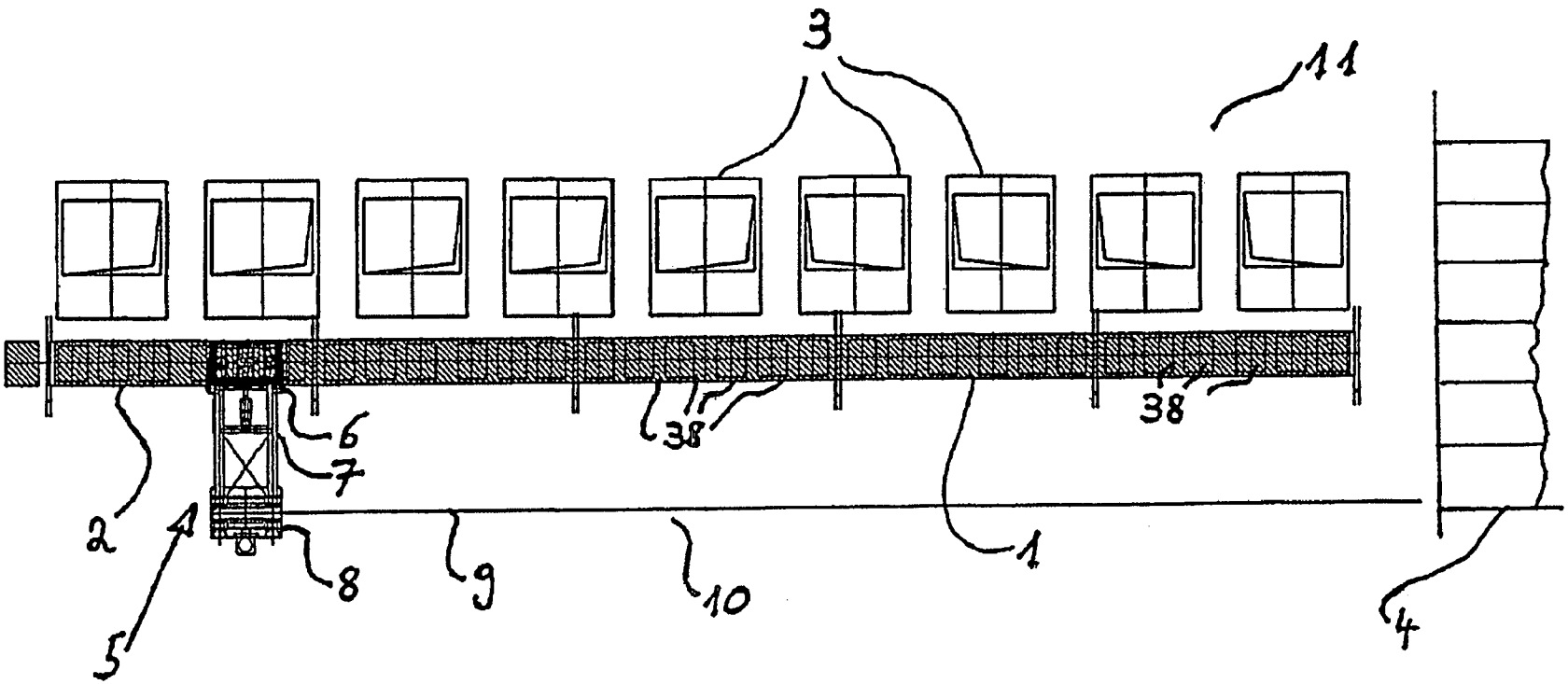
FIG. 1 is a top view of a schematic representation of a charging unit for a set of ovens with a device for compacting coal.

FIG. 1 represents a charging unit 11 for coke ovens with a coal cake 1 created in a stamping mold 2 and filling devices 3 as well as a set of ovens 4.

A device 5 as claimed in the invention with a structural unit 6 and a connection 7 to a holder 8, which is disposed so as to be mobile on rails 9, is installed on the charging unit 11. The rails 9 are only indicated in FIG. 1.

Figure 3:
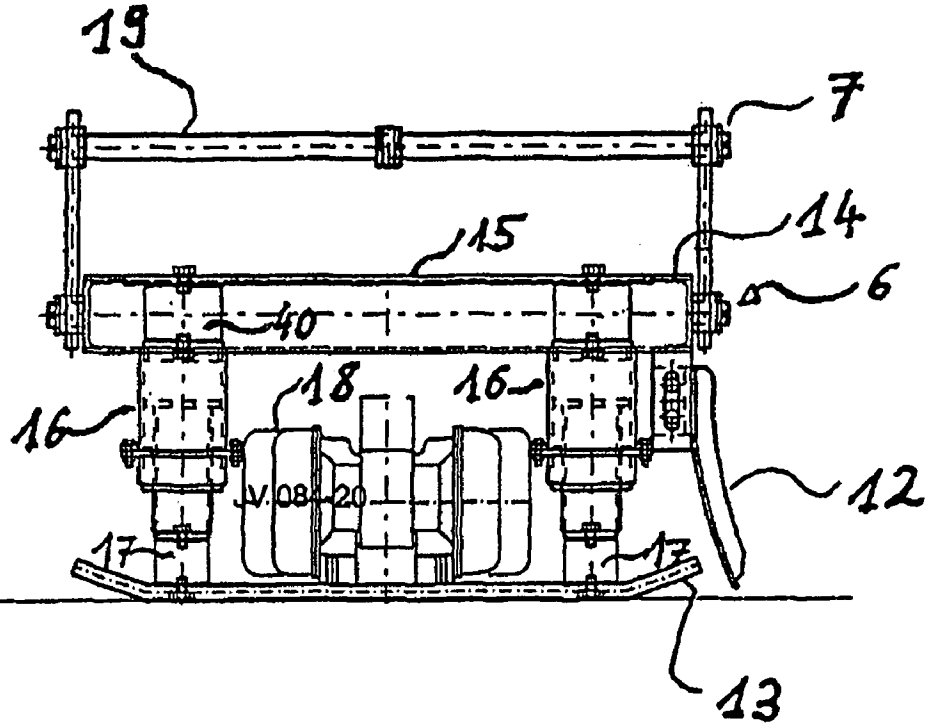
FIG. 3 is a different side view of the structural unit.
Figure 2:
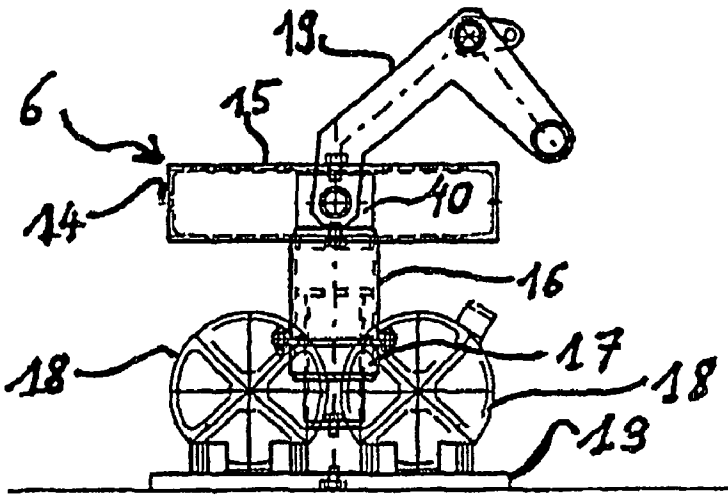
FIG. 2 is a side view of a structural unit with a rod assembly.

The structural unit 6 that is represented in more detail in FIGS. 2 and 3 comprises a scraper 12, an impact plate 13 and a device frame 14 that serves to connect the said parts.

The device frame 14 includes a sheet metal plate 15, on which vertical telescopic guides 16 are mounted by means of two damping elements 40, a said telescopic guides being connected to the impact plate 13, in their turn, by means of damping elements 17. The impact plate 13 is driven by two contrarotating unbalance motors 18, which are disposed on the said impact plate.

Figure 4:
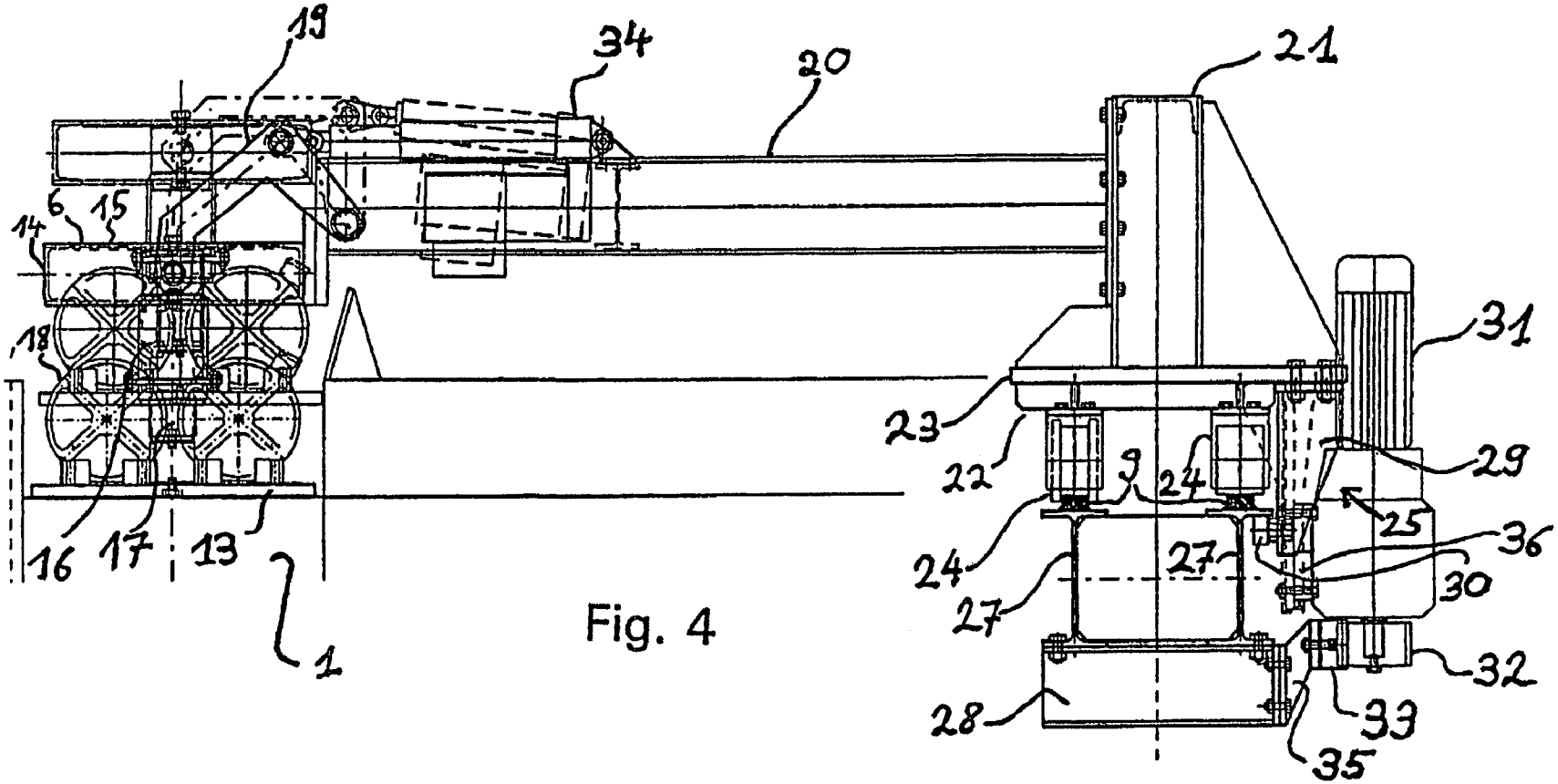
FIG. 4 is a side view of the structural unit and the rod assembly within the framework of a larger device.

As shown in FIG. 4, a vertically adjustable lever system 19 is secured on two sides of the device frame 14, the said lever system forming the connection to a boom 20 and being provided with an electrosetting drive 34. The lever system includes two angled levers 19, which are each pivotally secured on an outside of the structural unit 6 and of the boom 20. The setting drive 34 is pivotally retained on one side on the boom and on the other engages a transverse rod 39 of the holding rod assembly. The height of the structural unit is adjusted by means of the setting drive 34.

The boom 20 is retained by a support frame 21, which is supported on a mobile carriage 22.

The carriage 22 includes a plate 23 serving for securing purposes, rollers 24 each with a protective box 37, a double torque bracket 25 and a driving means 31. The rollers 24 are disposed on the aforementioned rails 9, which are secured and supported on interconnected double T girders 27. The double T girders 27 are supported on a base 28. Each torque bracket 25 has an arm 29 that protrudes downward from the plate 23, on which arm are mounted rollers 30, which engage under a T beam of a double T girder 27.

The driving means 31 that is secured to the carriage 22 by means of a holder 36 includes a toothed wheel 32, which engages in a toothed rack 33, which is secured by means of supports 35 to the base 28. The carriage 22 is moved by rotating the toothed wheel 32.

Figure 5:
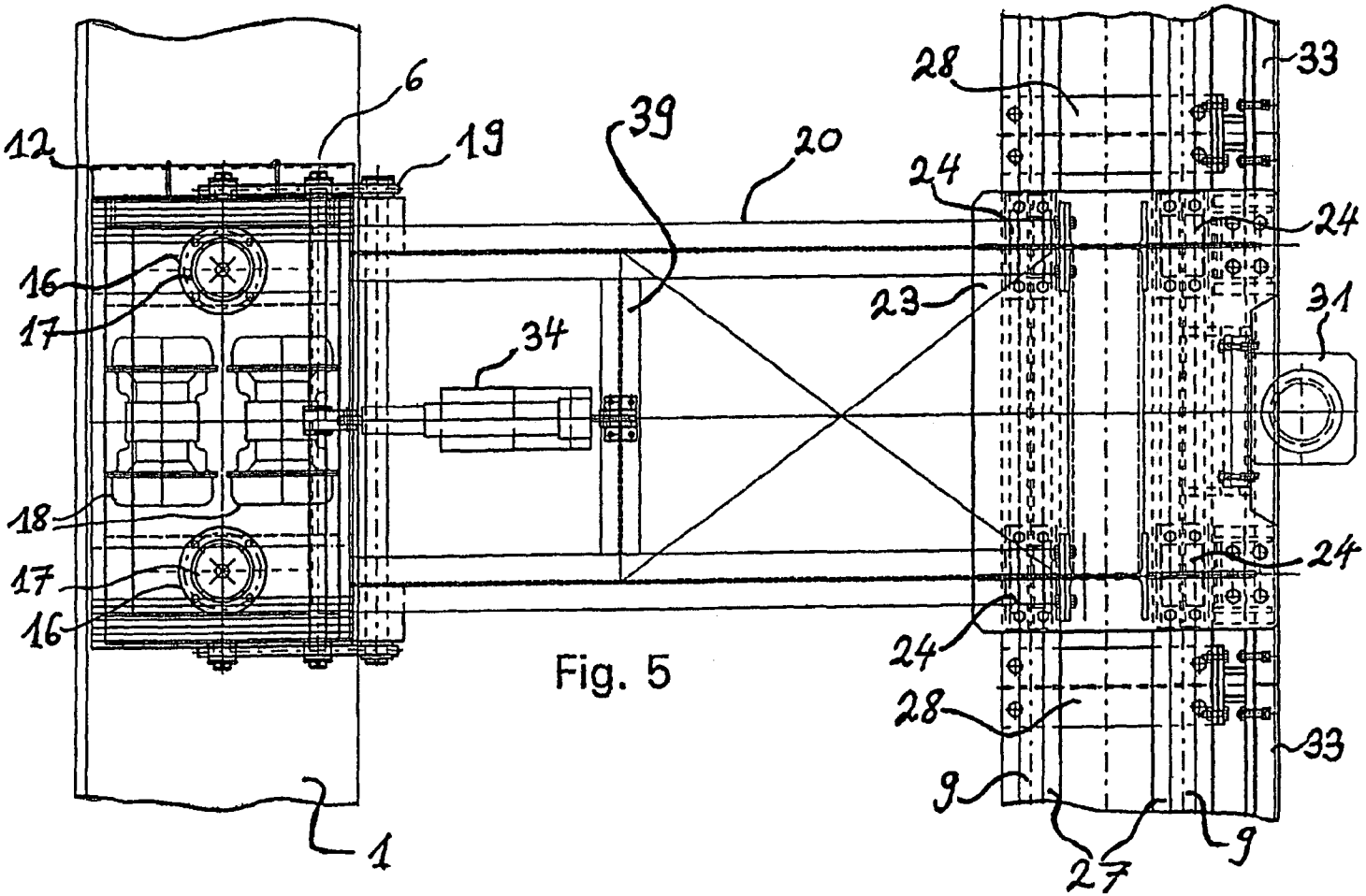
FIG. 5 is a top view of the device in FIG. 4
Figure 6:
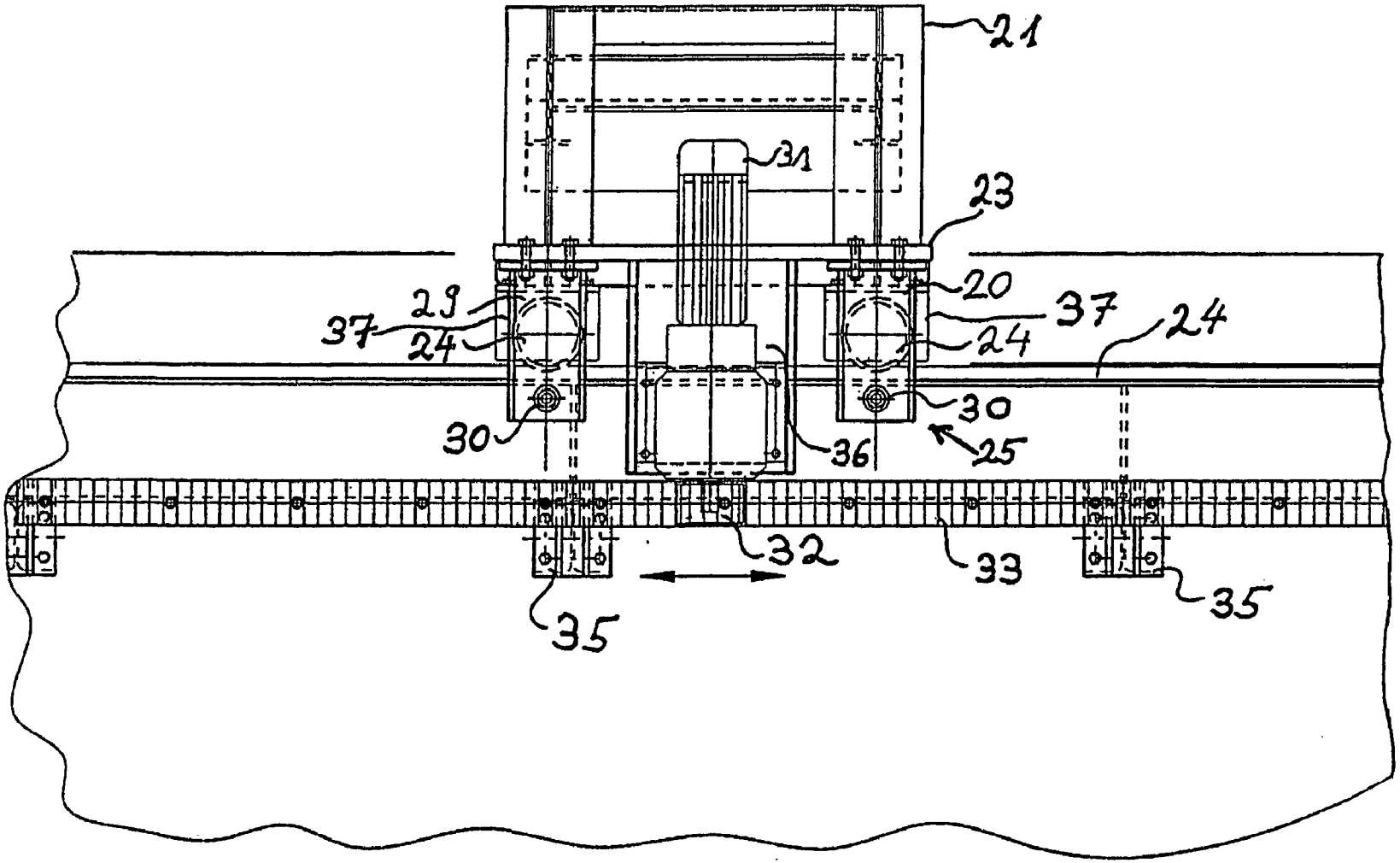
FIG. 6 is a side view of the device in FIG. 4 from the right according to FIG. 5.

FIG. 5 represents a top view of the device as claimed in the invention, from which the design of the device can be seen more easily. FIG. 6 is a side view showing how the holder 8 with the mobile carriage 22, the driving means 31, the rails 26 and the toothed rack 33 are disposed.

The coal is filled into the stamping mold 2 from the filling units 3 and is tamped by means of stampers (not represented) that are operated in the manner of drop hammers. Due to their construction, the stampers are only able to tamp individual regions 38 on the surfaces of the coal cakes. Consequently, peaks are formed with loose coal between the regions 38. The tamped regions 38 form valleys in a corresponding manner.

The structural unit 6 represented in detail in FIG. 3 is then moved over the surface of the coal cake 1. In so doing, the scraper 12 then displaces the loose coal from the peaks into the valleys. The coal is then beaten down on the coal cake by the impact plate 13.

The invention claimed is:

1. A method for removing loose coal on wavy surfaces of long, narrow coal cakes for pushing into a coke oven and that have been compacted by stamping and are used for coking, the method comprising the steps of: scraping off the loose coal; displacing the loose coal from peaks to valleys of the wavy surface of the coal cake: and beating down the loose coal on the coal cake.

2. A device for removing loose coal on wavy surfaces of long, narrow coal cakes for pushing into a coke oven and that have been compacted by stamping and are used for coking, the device comprising: a stamping mold; at least one scraper for displacing the loose coal from peaks to valleys of the wavy surface of the coal cake; at least one vertically displaceable impact plate; a holder for the scraper and the impact plate, the scraper and the impact plate being connected to the holder; and means for moving the scraper and the impact plate on the one hand and the stamping mold on the other hand relative to one another, the scraper and the impact plate being arranged behind one another in a direction of the relative movement, the scraper being positionable at a level of the surface of the compacted coal cake so that during the relative movement the scraper displaces the loose coal from the wave peaks into the wave valleys.

3. The device as claimed in claim 2, wherein the scraper is vertically adjustable.

4. The device as claimed in claim 2, and further comprising a frame that interconnects the scraper and the impact plate to form a structural unit, the frame being connected to the holder.

5. The device as claimed in claim 4, and further comprising a vertical guide rod having damping elements, the impact plate being connected to the device frame by the vertical rod guide.

6. The device as claimed in claim 4, wherein the scraper and the impact plate or respectively the structural unit are connected to the holder so as to be vertically adjustable.

7. The device as claimed in claim 2, and further comprising a mobile charging unit, means for filling the stamping mold and means for displacing the stamping mold, wherein the holder is disposed on the mobile charging unit next to the stamping mold, the stamping mold and the means for filling and displacing the stamping mold being associated with the charging unit, still further comprising a boom that extends from the holder, the scraper and the impact plate being connected to the boom, the holder including a torque bracket for torque generated by the boom.

8. The device as claimed in claim 7, wherein the structural unit is movable along the stamping mold, and further comprising driving means for moving the structural unit.

9. The device as claimed in claim 8, wherein the holder includes a guide that extends along the stamping mold and a cradle that is displaceable on said guide or a carriage that can be moved thereon.

10. The device as claimed in claim 9, and further comprising girders and rails disposed on the girders, wherein the carriage includes a support frame that holds the boom, still further comprising rollers that mount the carriage on the rails (9).

11. The device as claimed in claim 7, wherein the scraper and the impact plate or respectively the structural unit are disposed on the charging unit at an end of the stamping mold facing the coke oven, wherein the means for the relative movement also displace the coal cake into the coke oven.

12. The device as claimed in claim 6, and further comprising a rod assembly that connects the structural unit to the holder.

13. The device as claimed in claim 10, and further comprising a base, the girders being T girders that are interconnected and secured to the base, wherein the torque bracket is formed by at least one roller that is disposed under a side of a T girder.

* * * * *